US007551873B2

(12) United States Patent
Hiura

(10) Patent No.: US 7,551,873 B2
(45) Date of Patent: Jun. 23, 2009

(54) SHEET CONVEYING APPARATUS AND IMAGE FORMING APPARATUS

(75) Inventor: Hiroshi Hiura, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 187 days.

(21) Appl. No.: 11/530,575

(22) Filed: Sep. 11, 2006

(65) Prior Publication Data

US 2007/0057448 A1 Mar. 15, 2007

(30) Foreign Application Priority Data

Sep. 13, 2005 (JP) ..... 2005-266118

(51) Int. Cl.
*G03G 15/00* (2006.01)

(52) U.S. Cl. ..... 399/107; 399/110; 399/124; 109/67; 109/68

(58) Field of Classification Search ..... 399/21, 399/22, 107, 110, 124; 49/367; 312/215, 312/222, 292, 310, 326–329; 292/DIG. 15, 292/DIG. 21, DIG. 68; 16/82, 86 R, 86 B, 16/86 C; 109/67, 68; 271/256, 264; 400/691, 400/693

See application file for complete search history.

(56) References Cited

U.S. PATENT DOCUMENTS 590,818 A * 9/1897 Blackburn ..... 292/106
5,785,308 A * 7/1998 Flores et al. ..... 271/9.11
5,975,515 A * 11/1999 Capri et al. ..... 271/9.11
6,374,067 B1 * 4/2002 Park ..... 399/107
6,510,301 B2 * 1/2003 Tanaka ..... 399/125
6,564,019 B2 * 5/2003 Ahn et al. ..... 399/13
6,836,628 B2 * 12/2004 Funakoshi ..... 399/88
2004/0175210 A1 * 9/2004 Otaka ..... 399/318

FOREIGN PATENT DOCUMENTS

| | | |
|---|---|---|
| JP | 11-231594 | 8/1999 |
| JP | 11-1231594 | 8/1999 |
| JP | 2001-146339 | 5/2001 |
| JP | 2005-82307 | 3/2005 |

* cited by examiner

*Primary Examiner*—David M Gray
*Assistant Examiner*—Ryan D Walsh
(74) *Attorney, Agent, or Firm*—Fitzpatrick, Cella, Harper & Scinto

(57) ABSTRACT

A sheet conveying apparatus including: a plurality of doors for opening a sheet conveying path are provided vertically adjacent to one another in an apparatus main body, and openably and closably about an axis provided in a vertical direction; and a restricting mechanism, which restricts, before an upper door of the plurality of doors is closed, the closing of a door just below the upper door.

4 Claims, 19 Drawing Sheets

SHEET CONVEYING APPARATUS AND IMAGE FORMING APPARATUS

BACKGROUND OF THE INVENTION

1. Field of the Invention

The present invention relates to a sheet conveying apparatus and an image forming apparatus, and particularly to the construction of a door opened when the sheet jam or the like has occurred in a sheet conveying path.

2. Description of the Related Art

A conventional image forming apparatus such as a copying machine or a printer is provided with a sheet conveying path for conveying a sheet. In some cases, this sheet conveying path is designed such that when the sheet jam has occurred, an openable and closable door provided in an apparatus main body is opened so that the sheet can be taken out.

As such a sheet conveying apparatus, there is one in which for example, a part of a sheet conveying path for conveying the sheet to an image forming portion is provided in the door and when jam clearance or the like is to be effected, this door is opened to thereby open the sheet conveying path and make it easy to effect jam clearance or the like.

As a construction in which the door is opened and closed as described above, there is one as disclosed in Japanese Patent Application Laid-Open No. 2001-146339 wherein a door is slidden to be opened and closed, or one as disclosed in Japanese Patent Application Laid-Open No. 2005-082307 wherein a door is opened and closed in a vertical direction by a hinge. There is also one as disclosed in Japanese Patent Application Laid-Open No. H11-231594 wherein a door is opened and closed in a horizontal direction.

Description will first be made of the construction of an image forming apparatus provided with such a conventional sheet conveying apparatus.

FIG. 11 of the accompanying drawings is a perspective view of such a conventional image forming apparatus.

In FIG. 11, in the upper portion of the image forming apparatus main body (hereinafter referred to as the apparatus main body) 51 of the image forming apparatus 50, there is provided an original reading portion 41 having an image sensor or the like for applying light to an original, and converting reflected light into a digital signal. Also, there are provided a plurality of stages of sheet supplying cassettes 52*a*, 52*b*, 52*c* and 52*d* containing therein sheets to be supplied to an image forming portion provided in the interior of the apparatus main body 51 for forming an image on the sheet.

The interior of the apparatus main body 51 will now be schematically described with reference to FIG. 12 of the accompanying drawings. Provision is made of a sheet conveying apparatus 53 for conveying the sheet, and first and second discharging portions 58A and 59A. By the sheet conveying apparatus 53, the sheet contained in the sheet supplying cassettes 52*a*, 52*b*, 52*c* and 52*d*, after images have been formed thereon, are discharged to the first discharging portion 58A or the second discharging portion 59A by being changed over by a flapper 61.

In the image forming portion, an image transferred to an intermediate transfer belt 63 is transferred to the sheet by a secondary transfer roller 56*a* in a secondary transferring portion 56. Further, the sheet to which the toner image has transferred is heated and pressurized in a fixing portion 57 comprising a pair of fixing rollers 57*a* and 57*b*, whereby the toner image thereon is fixed. The sheet S on which the toner image has been fixed is conveyed by a pair of first conveying rollers 5 constituted by rollers 5*a* and 5*b*.

In FIGS. 11 and 12, a first door 1 is openably and closably provided with a rotation center shaft 4 (FIG. 15) provided so that the axis thereof may extend in a vertical direction on the rear side of a side of the apparatus main body 51 as a fulcrum. Also, on this first door 1, there are disposed a driven registration roller 62*b* constituting a pair of registration rollers 62 (a drive registration roller 62*a* and a driven registration roller 62*b*), the secondary transfer roller 56*a* and a roller 5*b* constituting a pair of first conveying rollers 5. Further, on this first door 1, there are mounted guide members 101*a*, 102*a* and 103*a* constituting first, second, third and fourth conveying paths 101, 102, 103 and 104, and a guide member 104*a* shown in FIG. 16 of the accompanying drawings which will be described later. Thereby, when the first door 1 is opened, the first, second, third and fourth conveying paths are opened and jam clearance can be effected easily. The first, second, third and fourth conveying paths 101, 102, 103 and 104 are vertically arranged.

A second door 11 above and adjacent to the first door 1 is openably and closably provided with a rotation center shaft 14 provided so that the axis thereof may extend in a vertical direction on the rear side of a side of the apparatus main body 51 as s fulcrum. Also, on this second door 11, there are disposed a roller 15*b* constituting a pair of second conveying rollers 15, and rollers 58*a* and 59*a* constituting pairs of first and second discharge rollers 58 and 59. Further, on this second door 11, there is mounted one guide member 105*a* constituting a fifth conveying path 105 shown in FIG. 16 which will be described later. Thereby, when the second door 11 is opened, the fifth conveying path 105 is opened and jam clearance can be effected easily.

Now, FIG. 13 of the accompanying drawings shows the construction of the inner wall surface side of the first door 1 and the second door 11. FIG. 13 shows the lock portion 1A of the first door 1 and the lock portion 11A of the second door 11. Here, the lock portion 1A of the first door 1 and the lock portion 11A of the second door 11 are provided with hooks 1*a* and 11*a* provided on the first and second doors 1 and 11, respectively, and latches 2 and 12 disengageably engaged with the hooks 1*a* and 11*a*, respectively.

These latches 2 and 12 have latch portions 2*a* and 12*a* disengageably engaged with the hooks 1*a* and 11*a*, respectively, lever portions 2*b* and 12*b*, and rotary shafts 2*c* and 12*c*, and are urged in the direction indicated by the arrow A about the rotary shafts 2*c* and 12*c* by urging means (not shown).

The latch portions 2*a* and 12*a* of the latches 2 and 12 are brought into engagement with the hooks 1*a* and 11*a*, whereby the first and second doors 1 and 11 can be fixed at positions forming first, second, third, fourth and fifth conveying paths 101, 102, 103, 104 and 105 which are sheet conveying paths. The pairs of first and second conveying rollers 5 and 15 are adapted to be urged in the direction indicated by the arrow C in FIG. 12 by urging means (not shown) and brought into pressure contact with each other when the first and second doors 1 and 11 have been fixed at the positions forming the conveying paths 101, 102, 103, 104 and 105.

Also, as shown in FIG. 11, on the front sides of the first and second doors 1 and 11, there are provided releasing buttons 3 and 13 for releasing the locking of the lock portions 1A and 11A. By depressing these releasing buttons 3 and 13, the latch portions 2*a* and 12*a* can be released from the hooks 1*a* and 11*a*, respectively. These releasing buttons 3 and 13 are outwardly urged by urging means (not shown).

Description will now be made of the operation of clearing the jammed sheet S in the conventional sheet conveying apparatus 53 of such a construction.

When as shown, for example, in FIG. 12, the sheet S is jammed at a position nipped by the pairs of first and second conveying rollers 5 and 15, the releasing button 3 is depressed in the direction indicated by the arrow D as shown in FIG. 14A so that the first door 1 may first be opened. When the releasing button 3 is thus depressed, the projection 3*a* of the releasing button 3 presses the lower portion 2*b* of the latch 2 urged in the direction indicated by the arrow A. Thereby, as shown in FIG. 14B of the accompanying drawings, the latch 2 is rotated in the direction indicated by the arrow E about the rotary shaft 2*c*, and when the latch 2 is thus rotated in the direction indicated by the arrow E, the engagement between the latch portion 2*a* and the hook portion 1*a* of the first door 1 is released.

Thereby, the first door 1 is rotated in the direction indicated by the arrow F about the rotation center shaft 4, as shown in FIG. 15, by the reaction force of urging means (now shown) urging the pair of first conveying rollers 5 in the direction indicated by the arrow C at the positions forming the first to fourth conveying paths 101, 102, 103 and 104. As the result, the first to fourth conveying paths 101, 102, 103 and 104 are opened and the pressure contact between the pair of first conveying rollers 5 (5*a* and 5*b*) is released.

Next, the second door 11 is opened. Again in this case, when the releasing button 13 is depressed, as in the case of the first door 1, the engagement between the latch portion 12*a* and the hook portion 11*a* of the second door 11 is released. Thereby, the second door 11 is rotated in the direction indicated by the arrow F, as shown in FIG. 16, by the reaction force of the urging means (not shown) urging the pair of second conveying rollers 15 at a position forming the fifth conveying path 105, and opens the fifth conveying path 105. As the result, the pressure contact between the pair of second conveying rollers 15 is released.

When the first and second doors 1 and 11 are thus opened, the pressure contact between the pair of first and second conveying rollers 5 and 15 is released and therefore, the jammed sheet S can be cleared easily.

After the jammed sheet S has been cleared, the first and second doors 1 and 11 are rotated in the direction indicated by the arrow G and closed, as shown in FIG. 17 of the accompanying drawings. When the first and second doors 1 and 11 are thus closed, the hooks 1*a* and 11*a* rotate the latches 2 and 12 urged in the direction indicated by the arrow A by the urging means (not shown) in the direction indicated by the arrow E, and are again engaged with the latch portions 2*a* and 12*a* of the latches 2 and 12, respectively.

By the hooks 1*a* and 11*a* being thus engaged with the latch portions 2*a* and 12*a* of the latches 2 and 12, respectively, the first and second doors 1 and 11 are fixed at the positions forming the first to fifth conveying paths 101, 102, 103, 104 and 105. Thereby, the pairs of first and second conveying rollers 5 and 15 are pressurized in the direction indicated by the arrow C indicated in FIG. 12 by the urging means (not shown), and the preparation for the conveyance of the next sheet is completed.

Now, in such a conventional sheet conveying apparatus and image forming apparatus, as already described, each door is opened before jam clearance is done and therefore, the releasing means (releasing button 13) for releasing the fixing means (lock means 1A and 11A) of the respective doors 1 and 11 is necessary for each door. However, in a case where the releasing means are provided on the doors 1 and 11, each time the doors 1 and 11 are opened, the respective releasing means must be operated, and the jam clearing operation has been cumbersome. So, as a countermeasure for simplifying the jam clearing operation, the portion opened in the jam clearance is made into a door long in the conveyance direction of the sheet. For example, as shown in FIG. 18 of the accompanying drawings, there is conceivable a method of making the two doors 1 and 11 into a single door 31.

However, when the two doors are thus made into a single door, each of the fixing means and the releasing means may be single, but the rollers 5*a* and 15*a* constituting the pairs of conveying rollers 5 and 15, respectively, are disposed on the single door 31. Therefore, when the door 31 is to be closed, the operating force is increased by the reaction force of the urging means for urging the pair of rollers.

That is, when as shown in FIG. 17, the force with which the first door 1 is closed is defined as F1, and the force with which the second door 11 is closed is defined F2, the force F3 with which the door 31 long in the conveyance direction shown in FIG. 19 of the accompanying drawings is closed becomes F3=F1+F2, and the operating force is increased. This has led to the problem that operability is bad.

SUMMARY OF THE INVENTION

So, the present invention has been made in view of such present situation, and has as its object to provide a sheet conveying apparatus and an image forming apparatus which can reduce the labor of a jam clearing operation.

The present invention provides a sheet conveying apparatus provided with a sheet conveying path for conveying a sheet, having:

a plurality of doors provided vertically adjacent to one another in an apparatus main body, and supported openably and closably about an axis provided in a vertical direction for opening the sheet conveying path; and a restricting mechanism, which restricts, before the upper door of the plurality of doors is closed, the closing of the just-underlying door just below the upper door.

Further features of the present invention will become apparent from the following description of exemplary embodiments with reference to the attached drawings.

DESCRIPTION OF THE EMBODIMENTS

The best form for carrying out the present invention will hereinafter be described in detail with reference to the drawings.

Figure 1:
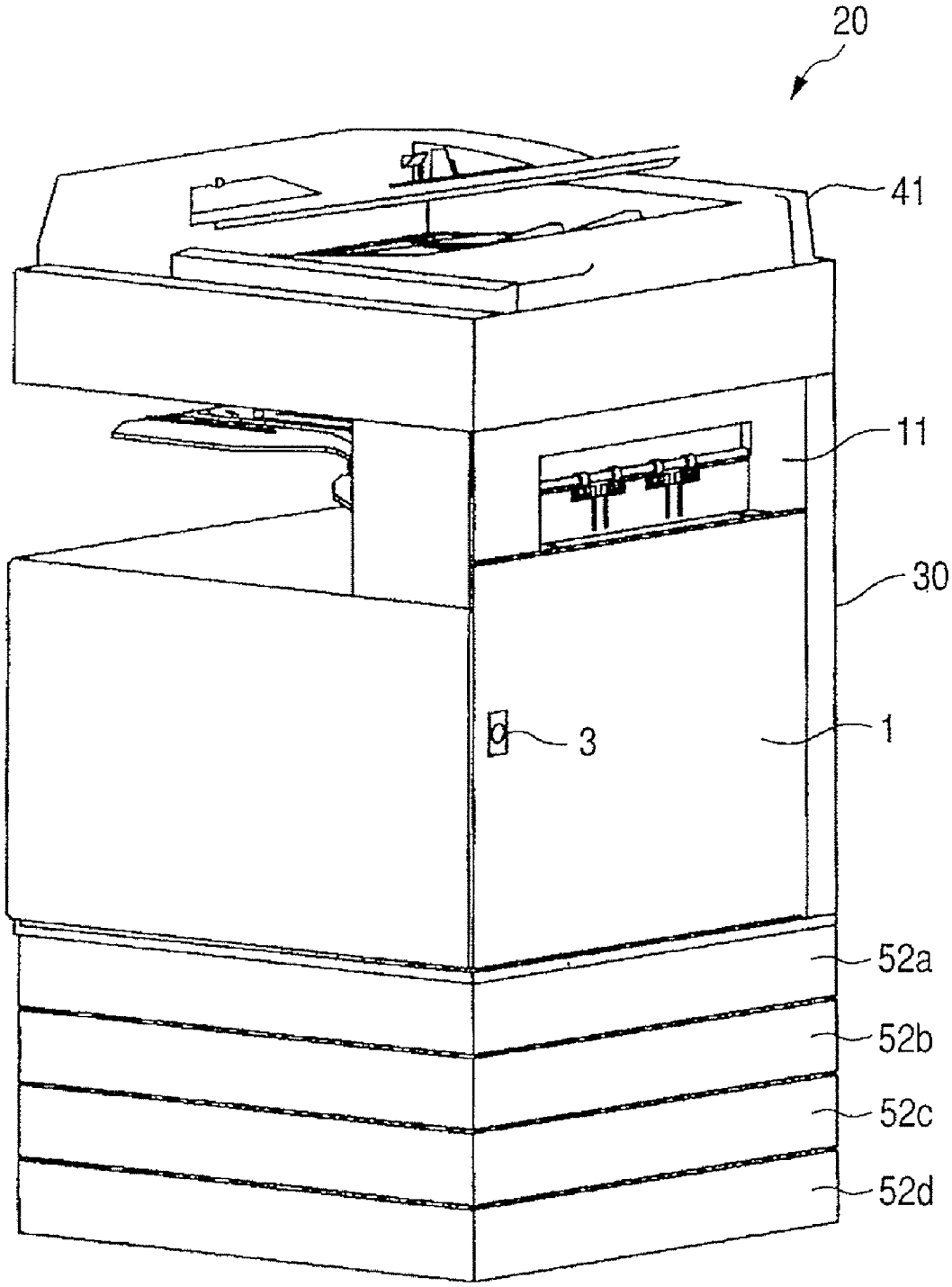
FIG. 1 is a perspective view of an image forming apparatus provided with a sheet conveying apparatus according to an embodiment of the present invention.
Figure 11:
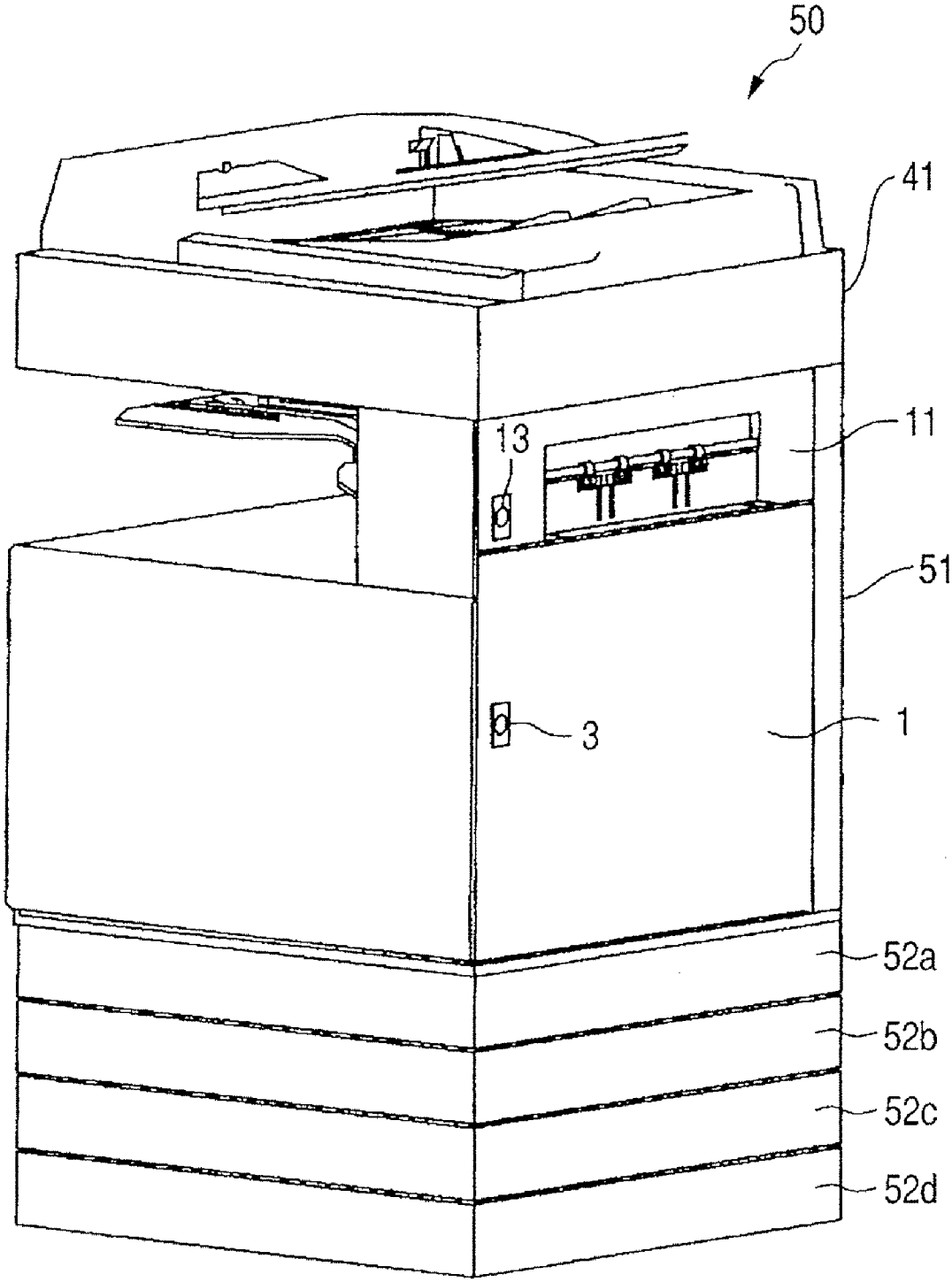
FIG. 11 is a perspective view of an image forming apparatus provided with a conventional sheet conveying apparatus.

FIG. 1 is a perspective view of an image forming apparatus provided with a sheet conveying apparatus according to an embodiment of the present invention. In FIG. 1, the same reference characters as those in FIG. 11 already described designate the same or corresponding portions.

In FIG. 1, an original reading portion 41 is provided in the upper portion of the image forming apparatus main body 30 of the image forming apparatus 20. Also, a first door 1 and a second door 11 are openably and closably provided on a side wall surface of the image forming apparatus main body 30. The relation between each door and a conveying path (guide member) is the same as that described in the conventional art and therefore, need not be described.

Figure 10:
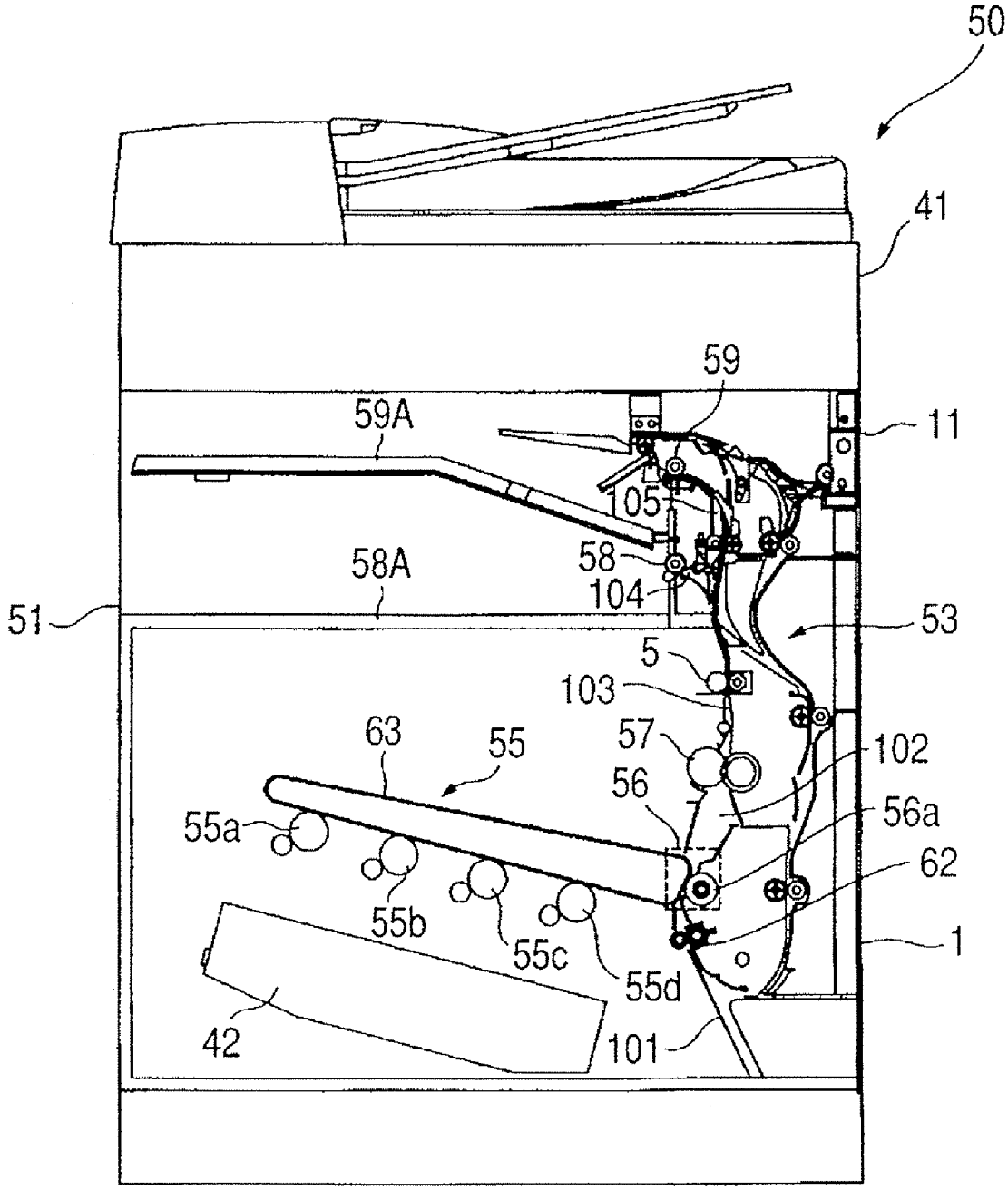
FIG. 10 schematically shows the construction of the image forming apparatus of the present invention.

The image forming apparatus will now be described schematically with reference to FIG. 10. The same members as the members described in the conventional art are given the same reference characters. An image forming portion 55 is provided with photosensitive drums 55*a*, 55*b*, 55*c* and 55*d* for forming toner images of four colors, i.e., yellow, magenta, cyan and black, and a scanner portion 42 for applying a laser beam on the basis of image information to thereby form electrostatic latent image on the photosensitive drums.

As intermediate transfer belt 63 is rotatively driven in the direction indicated by the arrow. A transferring bias is applied to this intermediate transfer belt 63, whereby the toner images of the respective colors on the photosensitive drums are successively multiplexly transferred to the intermediate transfer belt 63, and a full-color image is formed on the intermediate transfer belt 63. Also, a secondary transferring portion 56 sequentially transfers the full-color image formed on the intermediate transfer belt 63 to a sheet. A fixing portion 57 fixes the image on the sheet. A pair of first discharge rollers 58 discharge the sheet on which the image has been fixed to a first discharging portion 58A. A pair of second discharge rollers 59 discharge the sheet on which the image has been fixed to a second discharging portion 59A.

Description will now be made of the image forming operation of the image forming apparatus 50 constructed as described above.

When the image forming operation is started, the image of an original is first read by the original reading portion 41, and on the basis of this read original image information, the scanner portion 42 applies a laser beam to thereby successively exposure the surface of the photosensitive drums 55*a*, 55*b*, 55*c* and 55*d* uniformly charged to a predetermined polarity and potential to the laser light. Thereby, yellow, magenta, cyan and black latent image are formed on the photosensitive drums 55*a*, 55*b*, 55*c* and 55*d*, respectively.

Next, the latent images on the photosensitive drums 55*a*, 55*b*, 55*c* and 55*d* are developed with yellow, magenta, cyan and black toners, respectively, to thereby successively form yellow, magenta, cyan and black toner images on the photosensitive drums. Then, the respective color toner images thus successively formed are successively primary-transferred to the outer periphery of the intermediate transfer belt 63, whereby a full-color toner image is formed on the intermediate transfer belt 63.

Also, in parallel with this toner image forming operation, sheets contained in sheet supplying cassettes 52*a*, 52*b*, 52*c* and 52*d* are conveyed one by one to a pair of registration rollers 62 first via a first conveying path 101 by a sheet conveying apparatus 53. Then, the sheet has its skew feed corrected by the pair of registration rollers 62, and thereafter is conveyed to the secondary transferring portion 56 by the pair of registration rollers 62 at such timing that the full-color toner image formed on the intermediate transfer belt 63 and the leading edge of the sheet coincide with each other. When the sheet passes through this secondary transferring portion 56, the toner image on the intermediate transfer belt is secondary-transferred to the sheet by a bias applied to a secondary transfer roller 56*a*.

Next, the sheet to which the toner image has been thus transferred is conveyed to the fixing portion 57 via a second conveying path 102, and is heated and pressurized in the fixing portion 57, whereby the toner image thereon is fixed. After the image has been fixed in this manner, the sheet S is conveyed to a flapper 61 shown in FIG. 12 via a third conveying path 103 by a pair of first conveying rollers 5 provided downstream of the fixing portion 57.

If the position of this flapper 61 is the position of broken line, the sheet S passes through a conveying path 104 and is discharged by the pair of first discharge rollers 58 and is stacked on the first discharging portion 58A. Also, if the position of the flapper 61 is the position of solid line, the sheet S is discharged via a pair of second conveying rollers 15 and a fifth conveying path 105 by the pair of second discharge rollers 59 and is stacked on the second discharging portion 59A.

Figure 2:
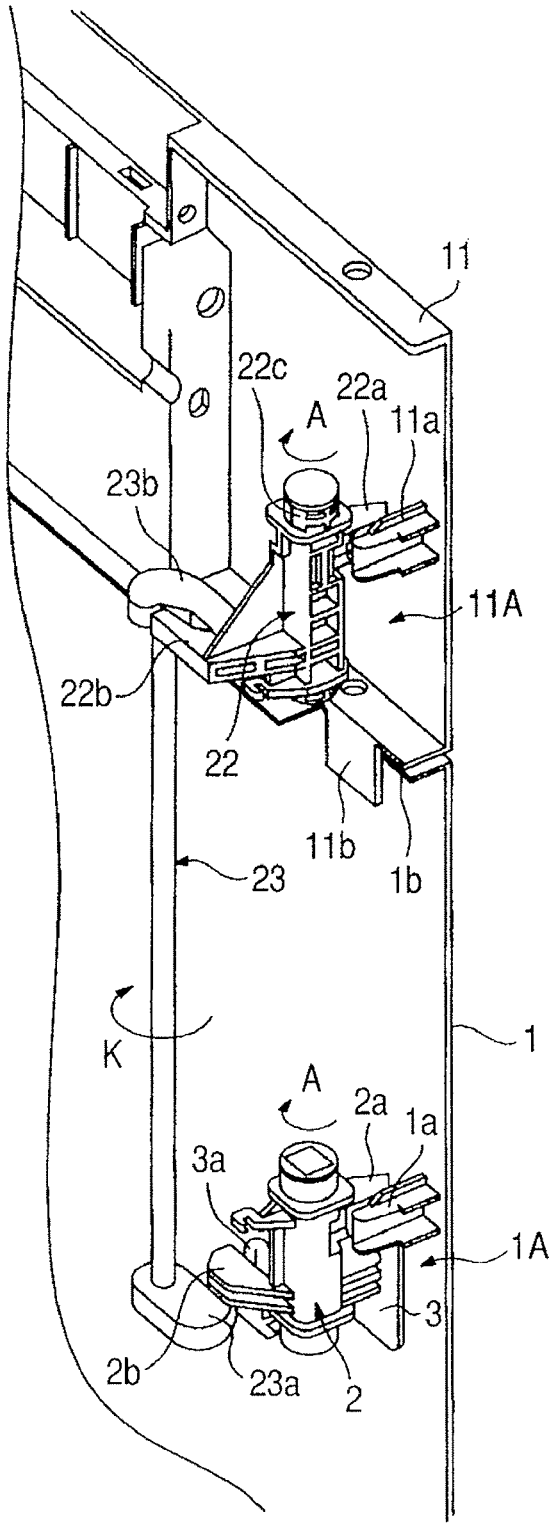
FIG. 2 shows the construction of the inner wall surface sides of a first door and a second door of the sheet conveying apparatus.

FIG. 2 shows the construction of the inner wall surface sides of the first door 1 and the second door 11, and in FIG. 2, the reference character 1A designates a lock portion which is the lock means of the first door 1, and the reference numeral 11A denotes a lock portion which is the lock means of the second door 11. The lock portion 1A of the first door 1 is provided with a hook 1*a* provided on the first door 1, and a latch 2 engaged with this hook 1*a* to thereby fix the first door 1 at a position forming the conveying paths 101, 102 and 103. Also, the lock portion 11A of the second door 11 is provided with a hook 11*a* provided on the second door 11, and a latch 22 engaged with this hook 11*a* to thereby fix the second door 11 at a position forming the conveying paths 104 and 105.

Here, the latch 22 of the lock portion 11A of this second door 11 is disengageably engaged with the hook 11*a* of the second door 11 to thereby fix the second door 11 at a position forming the fifth conveying path 105. This latch 22 has a latch portion 22*a* disengageably engaged with the hook 11*a* of the second door 11, a lever portion 22*b* and a rotary shaft 22*c*. It is urged in the direction indicated by the arrow A about the rotary shaft 22*c* by urging means (not shown).

The reference numeral 23 designates a releasing lever which is releasing means provided on the first door 1 for rotation in a horizontal direction for releasing the engagement of the hook 11*a* with the latch portion 22*a* to thereby release the locking of the lock portion 1A of the first door 1.

The lower end portion of this releasing lever 23 is provided with an abutment portion 23*a* for abutting against the tip end portion 3*b* of a releasing button 3 which is an operating portion provided on the first door 1 when the releasing button 3 has been depressed. If the abutment portion 23*a* abuts against the tip end portion 3*b* of the releasing button 3 when the releasing button 3 has been depressed, the releasing lever 23 is adapted to rotate in a direction indicated by the arrow K.

Figure 3:
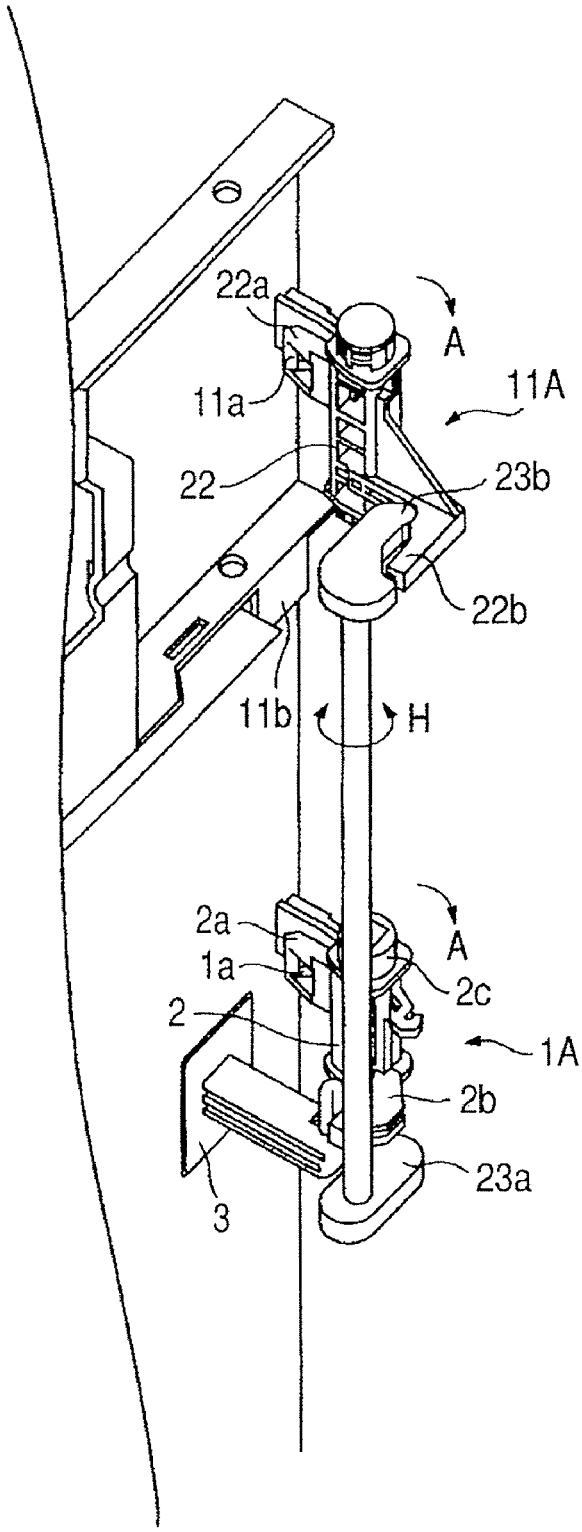
FIG. 3 illustrates a construction for releasing the locking of the first door and the second door.

Also, the upper end portion of this releasing lever 23 is provided with a pressing portion 23*b* for pressing the latch portion 22*a* of the lock portion 11A of the second door 11, as shown in FIG. 3, with the rotation of the releasing lever 23 in the direction indicated by the arrow K. When the pressing portion 23*b* presses the latch portion 22*a* with the rotation of this releasing lever 23 in the direction indicated by the arrow K, the latch portion 22*a* is released from the hook 11*a*, and the locking of the lock portion 11A of the second door 11 is released. This releasing lever 23, when the second door 11 is closed, is urged in the direction indicated by the arrow H by the latch 22 urged in the direction indicated by the arrow A.

The reference character 11*b* denotes a stopper provided on the second door 11, and the reference character 1*b* designates an abutment portion provided on the first door 1 and abutting against the stopper 11*b*, and by the abutment portion 1*b* being thus provided on the first door 1, the second door 11 is adapted to be not opened more greatly than the first door 1. That is, by the stopper 11*b* and the abutment portion 1*b*, the opening amount of the second door 11 which is an upper door is restricted so as to be smaller than the opening amount of the first door 1 which is a just-underlying door.

Description will now be made of the operation of clearing the jammed sheet S in the sheet conveying apparatus constructed as described above.

Figure 4:
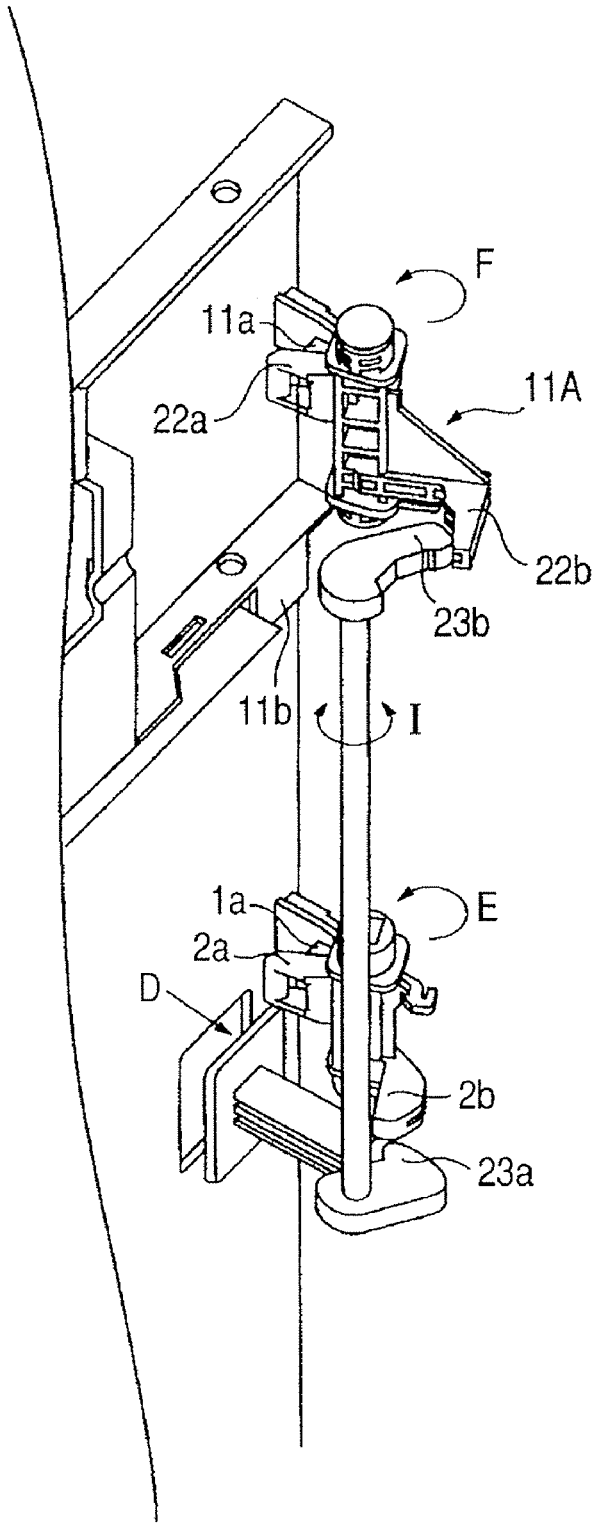
FIG. 4 illustrates the operation of releasing the locking of the first door and the second door.
Figure 5A:
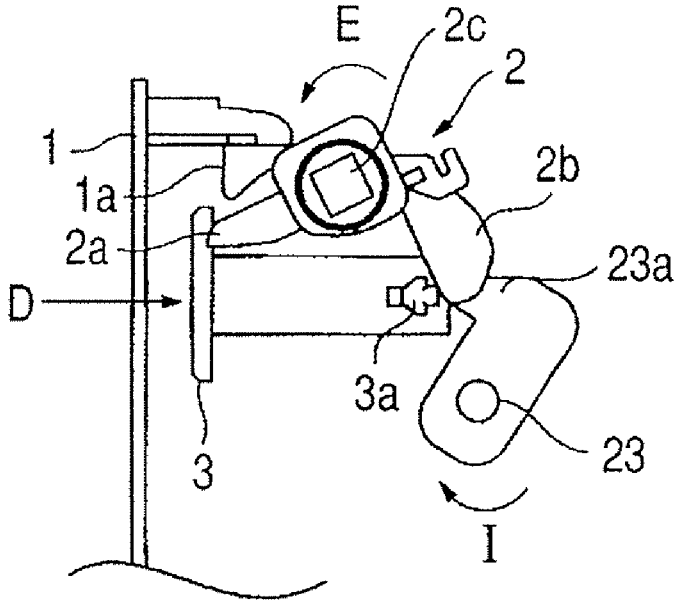
FIGS. 5A and 5B are other views illustrating the operation of releasing the locking of the first door and the second door.
Figure 12:
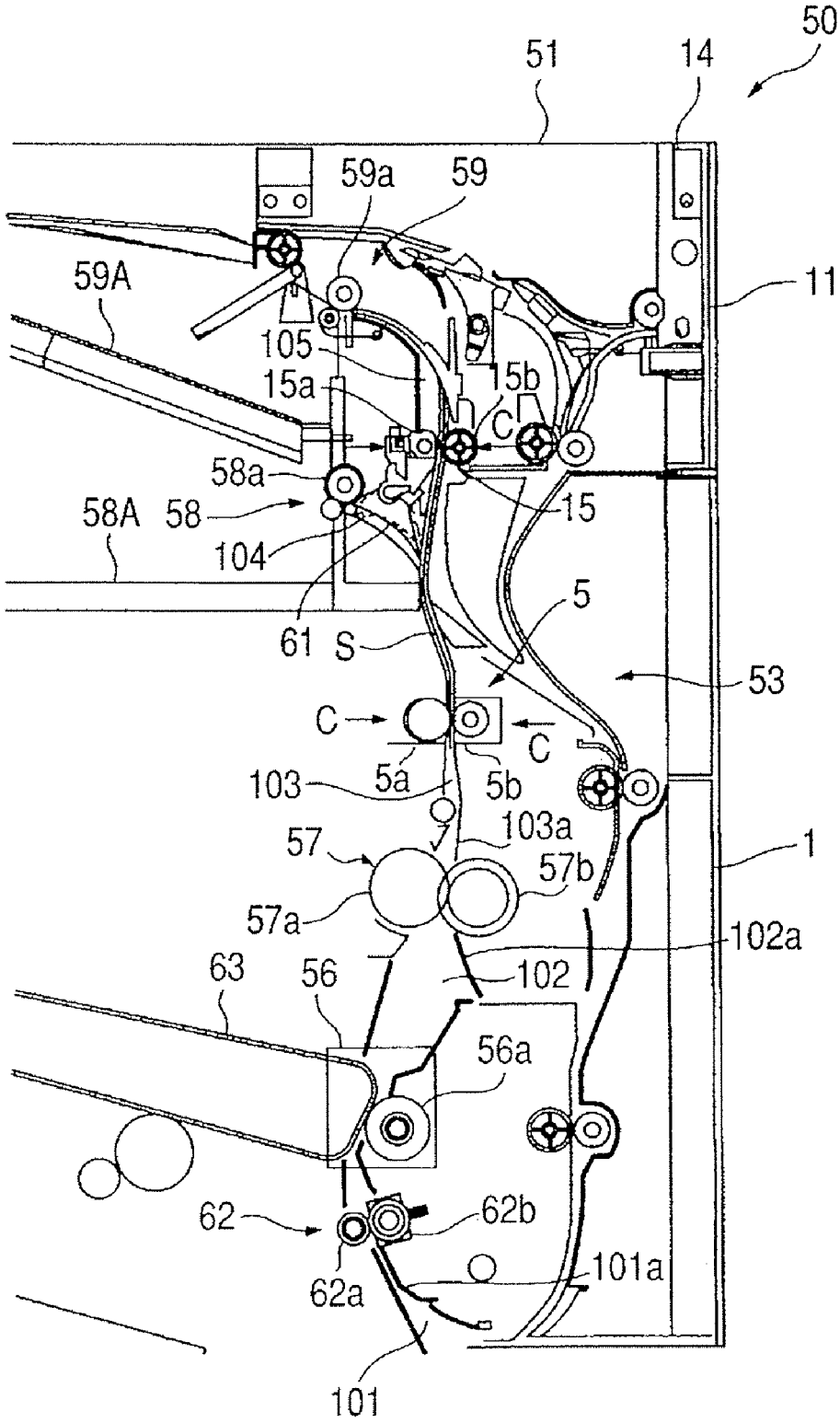
FIG. 12 shows the construction of the conventional sheet conveying apparatus.
Figure 13:
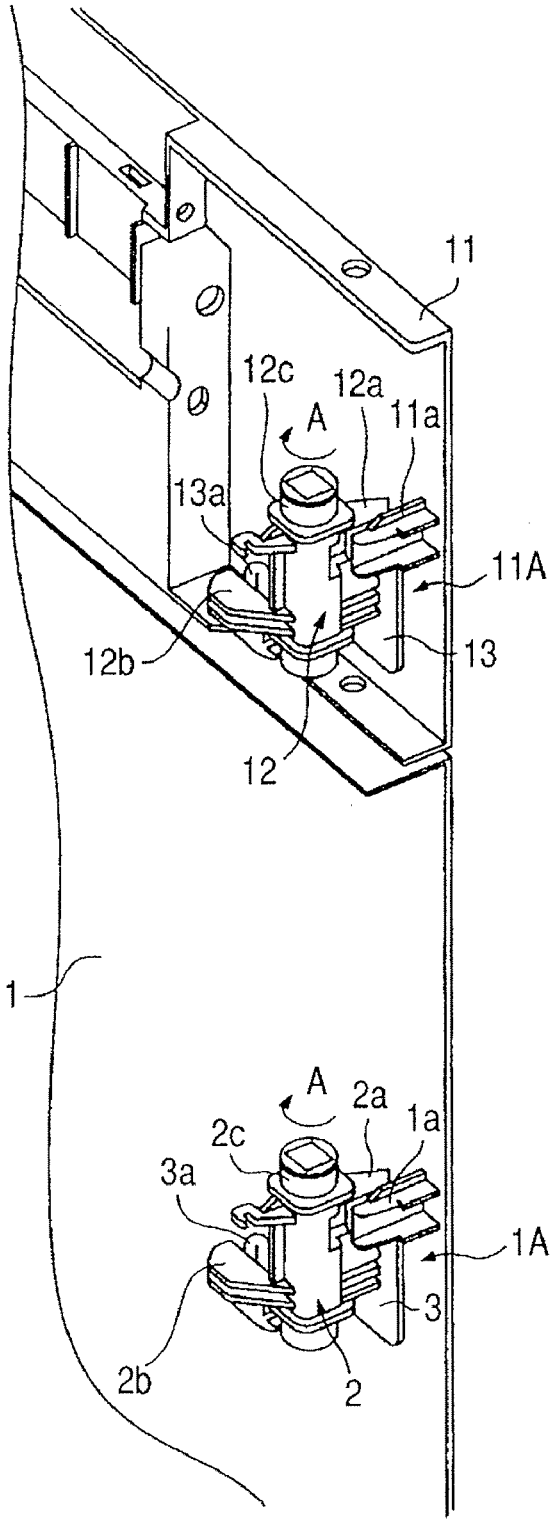
FIG. 13 shows the construction of the inner wall surface sides of a first door and a second door of the conventional sheet conveying apparatus.
Figure 14A:
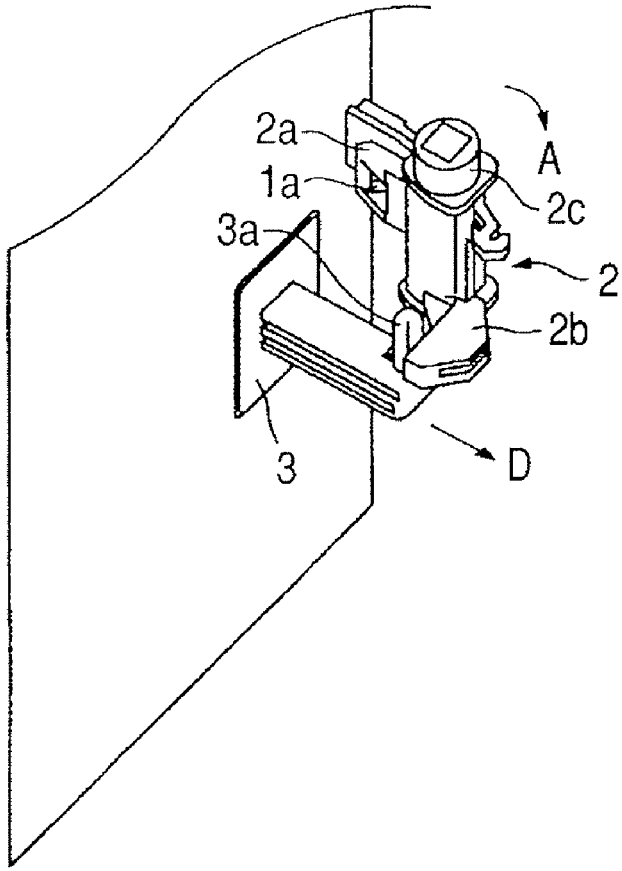
FIGS. 14A and 14B illustrate the operation of releasing the lock of the conventional first door and second door.
Figure 14B:
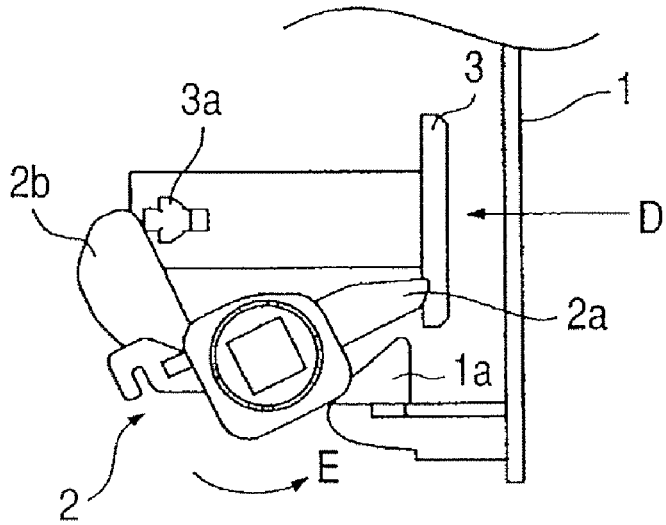

When for example, the sheet S is jammed at a position nipped between the pairs of first and second conveying rollers 5 and 15 shown in FIG. 12 already described, the releasing button 3 is depressed in the direction indicated by the arrow D as shown in FIG. 4 so as to open the first door 1 at first. Here, when the releasing button 3 is depressed, as shown in FIG. 5A, the projection 3*a* of the releasing button 3 pushes the lever portion 2*a* of the latch 2 to thereby rotate the latch 2 in the direction indicated by the arrow E about a rotary shaft 2*c*. When the latch 2 is thus rotated in the direction indicated by the arrow E, the engagement between the latch 2*a* and the hook portion 1*a* of the first door 1 is released, and the locking of the lock portion 1A of the first door 1 is released.

Figure 15:
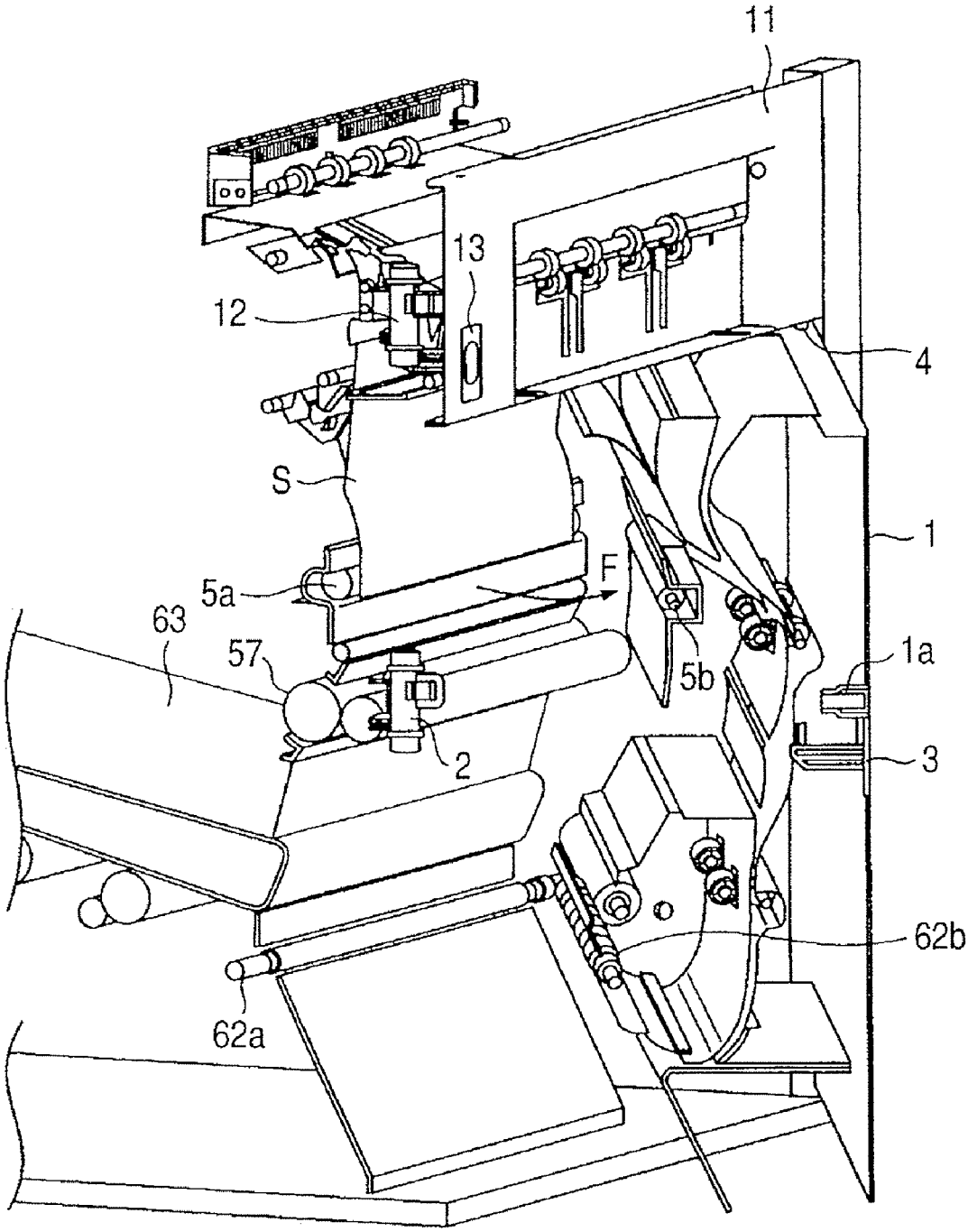
FIG. 15 shows a state when the conventional first door has been opened.
Figure 16:
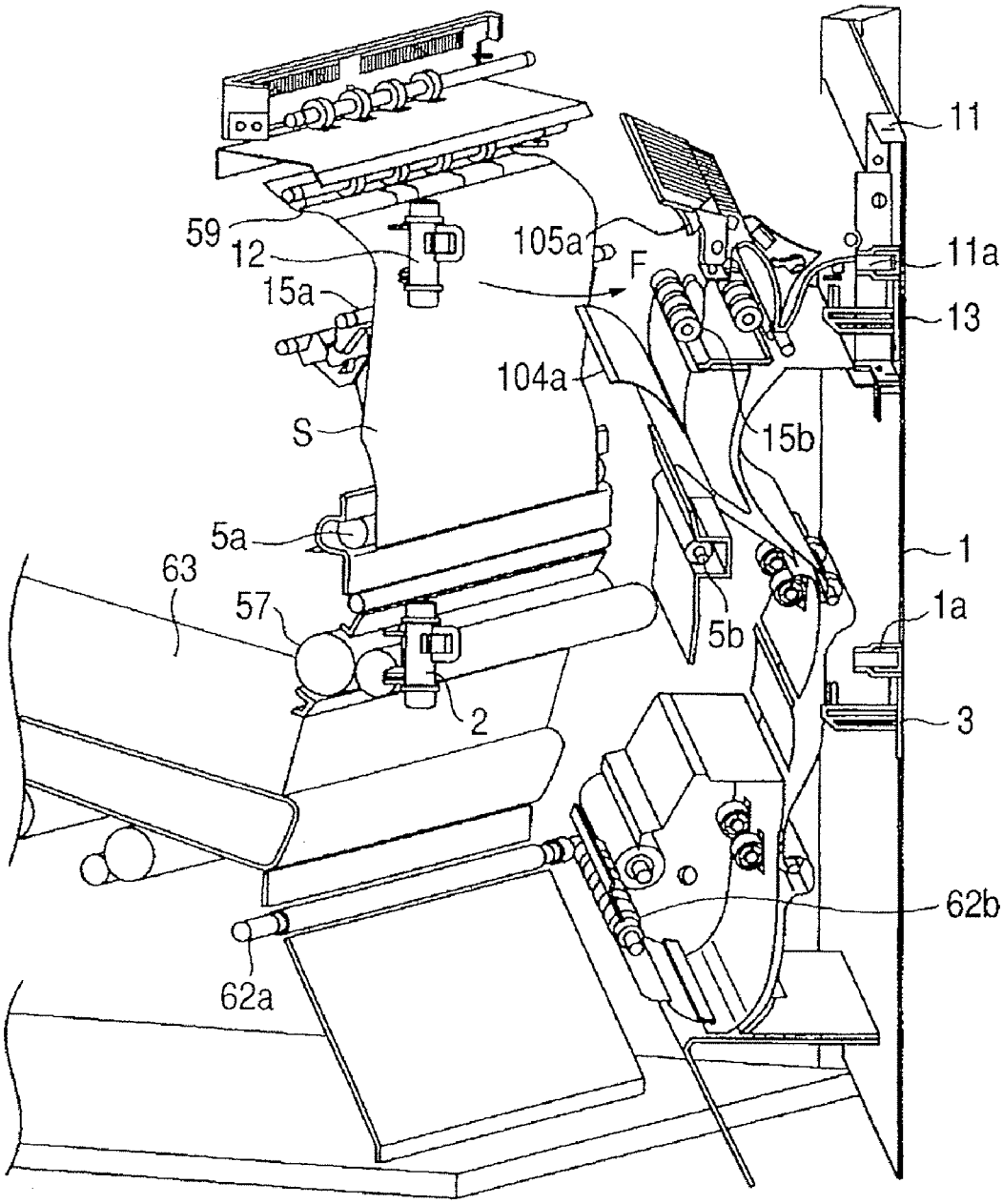
FIG. 16 shows a state when the conventional first door and second door have been opened.
Figure 17:
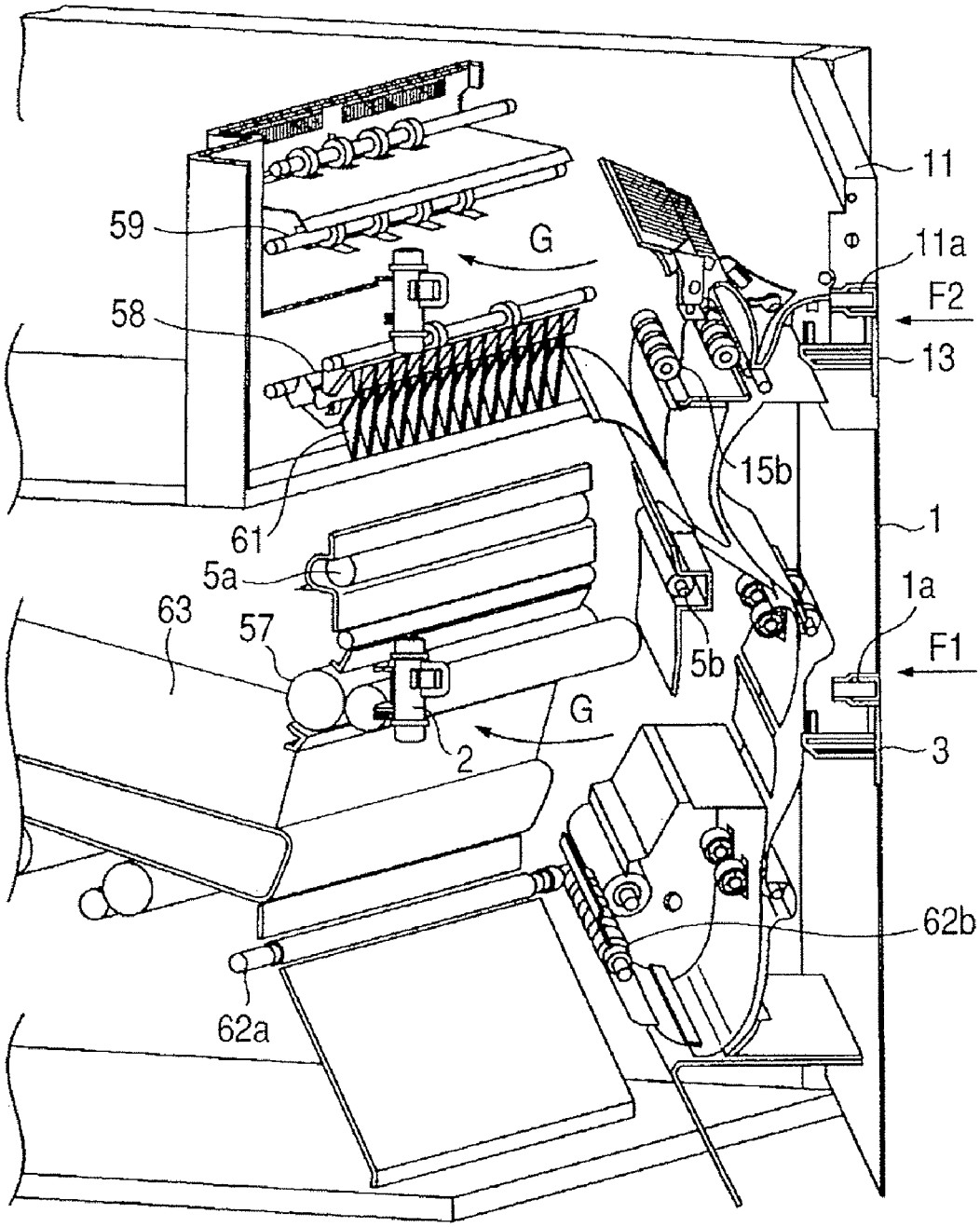
FIG. 17 shows a state when the conventional first door and second door are closed.
Figure 18:
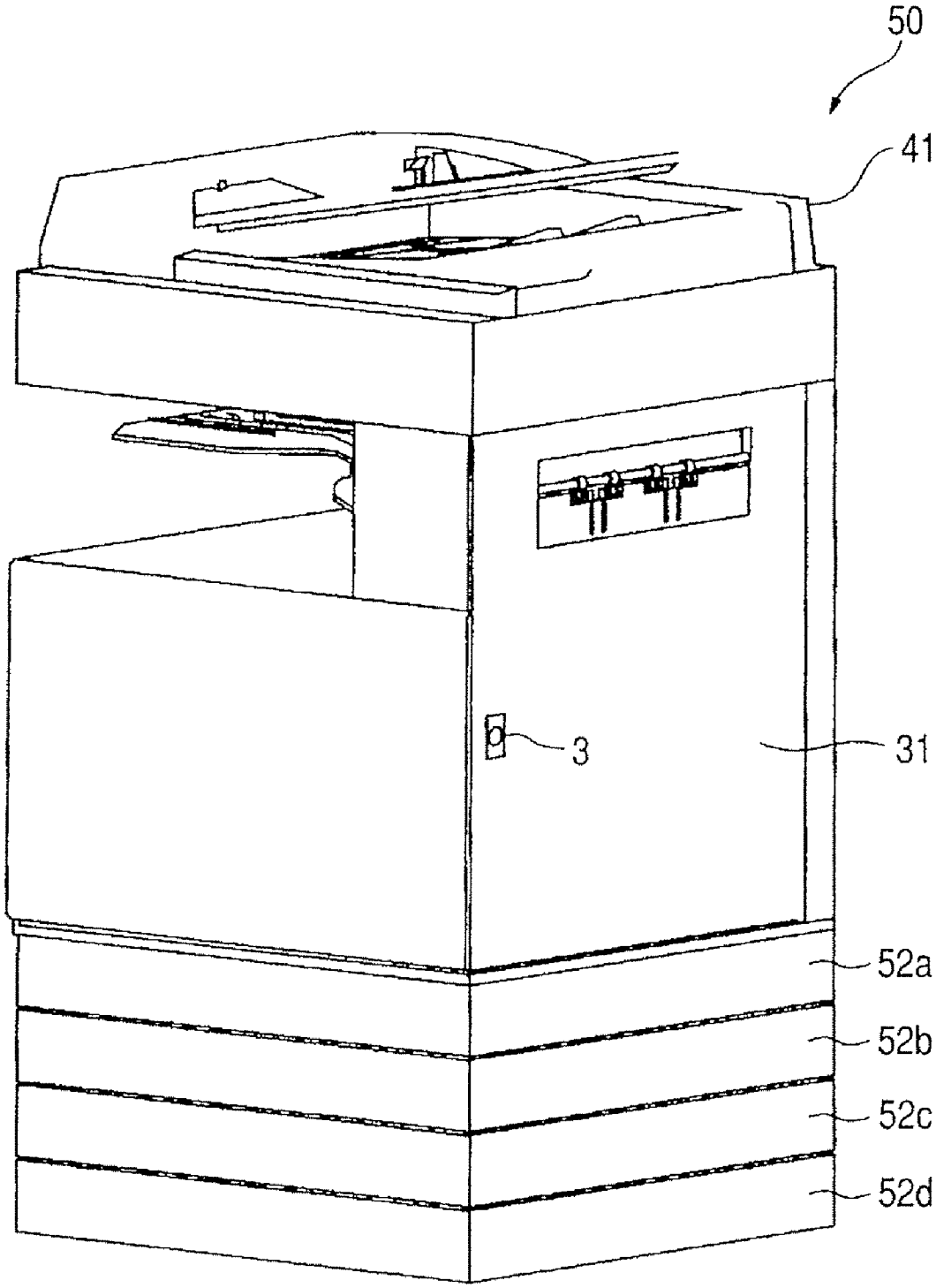
FIG. 18 is a perspective view of an image forming apparatus provided another conventional sheet conveying apparatus.
Figure 19:
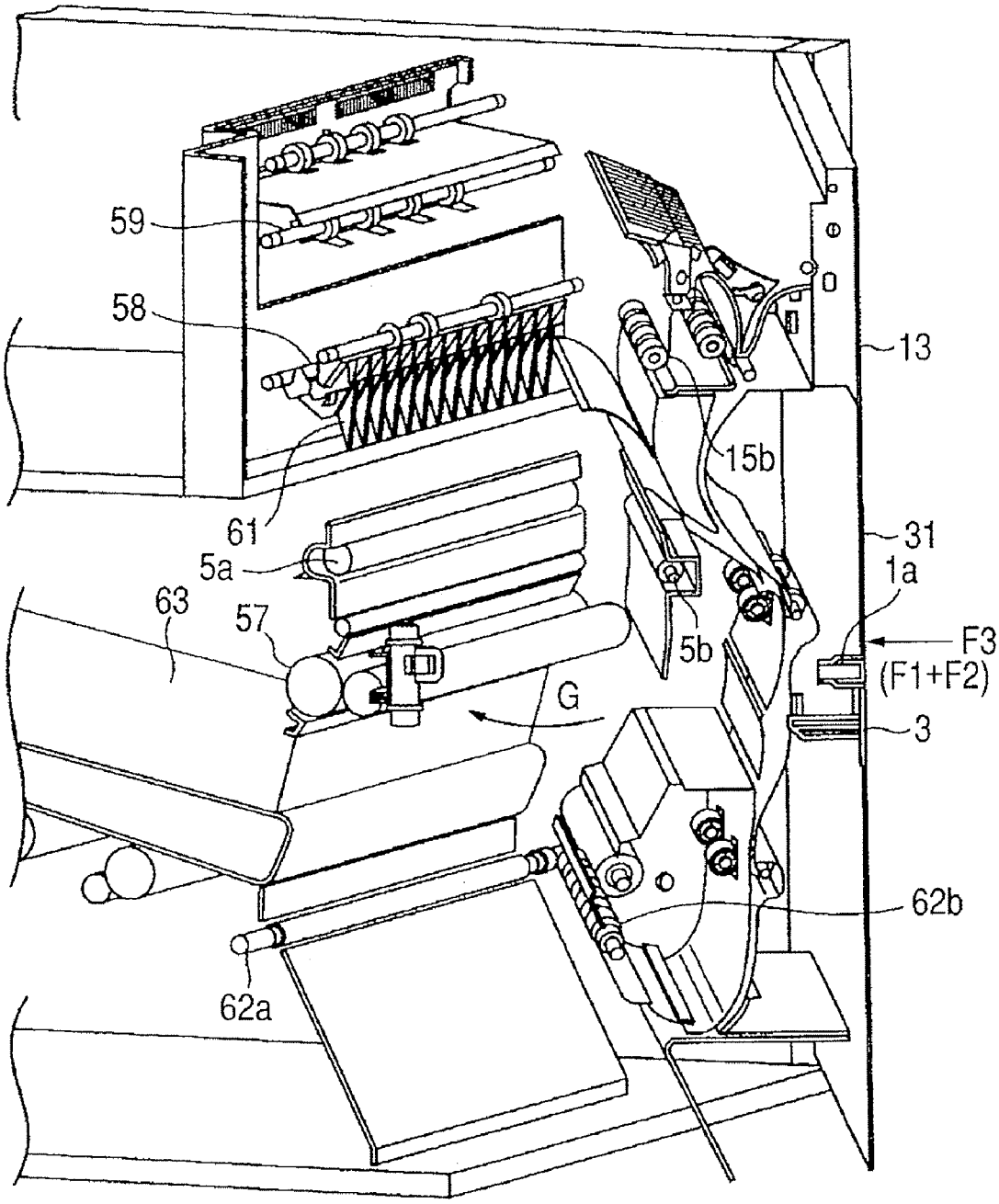
FIG. 19 shows a state when a first door and a second door of the aforementioned another conventional sheet conveying apparatus are closed.

Thereby, the first door 1 is rotated in the direction indicated by the arrow F about the rotation center shaft 4 as shown in FIG. 15 already described, by the reaction force of urging means (not shown) urging the pair of first rollers 5 in the direction indicated by the arrow C at a position forming the first, second, third and fourth conveying paths 101, 102, 103 and 104. As the result, the first, second, third and fourth conveying paths 101, 102, 103 and 104 are opened, and the pressure contact between the pair of first conveying rollers 5 is released.

Figure 5B:
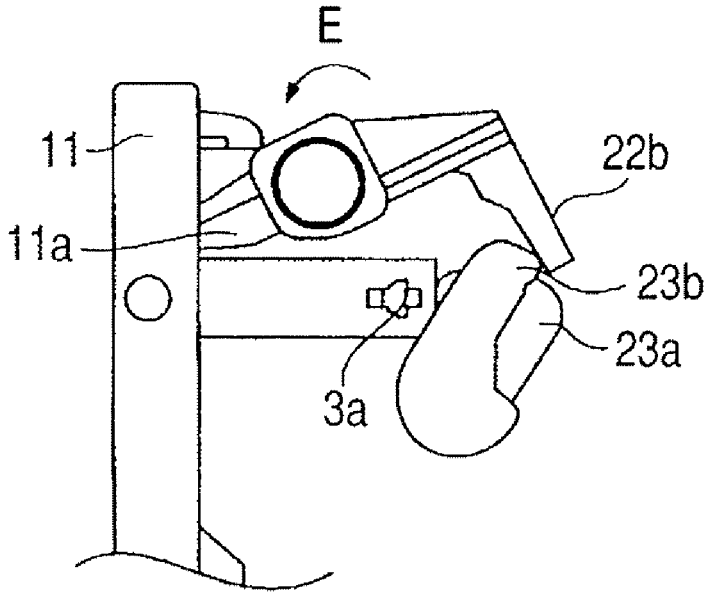

Also, at the same time, the tip end portion 3*b* of the releasing button 3 presses the abutment portion 23*a* of the releasing lever 23, and rotates the releasing lever 23 in the direction indicated by the arrow I shown in FIG. 4. Further, along therewith, the pressing portion 23*b* is also rotated in the direction indicated by the arrow I to thereby press the lever portion 22*b* of the latch 22, as shown in FIG. 5B, and rotate the latch portion 22*a* of the latch 22 in the direction indicated by the arrow E about the rotary shaft 22*c*.

When the latch portion 22*a* is thus rotated in the direction indicated by the arrow E, the engagement between the latch portion 22*a* and the hook portion 11*a* of the second door 11 is released, and the locking of the lock portion 11A of the second door 11 is released. Thereby, the second door 11 is rotated in the direction indicated by the arrow F by the reaction force of urging means (not shown) urging the pair of second conveying rollers 15 in the direction indicated by the arrow C at a position forming a conveying path, and as the result, the fifth conveying path 105 is opened and the pressure contact between the pair of second conveying rollers 15 is released.

Figure 6:
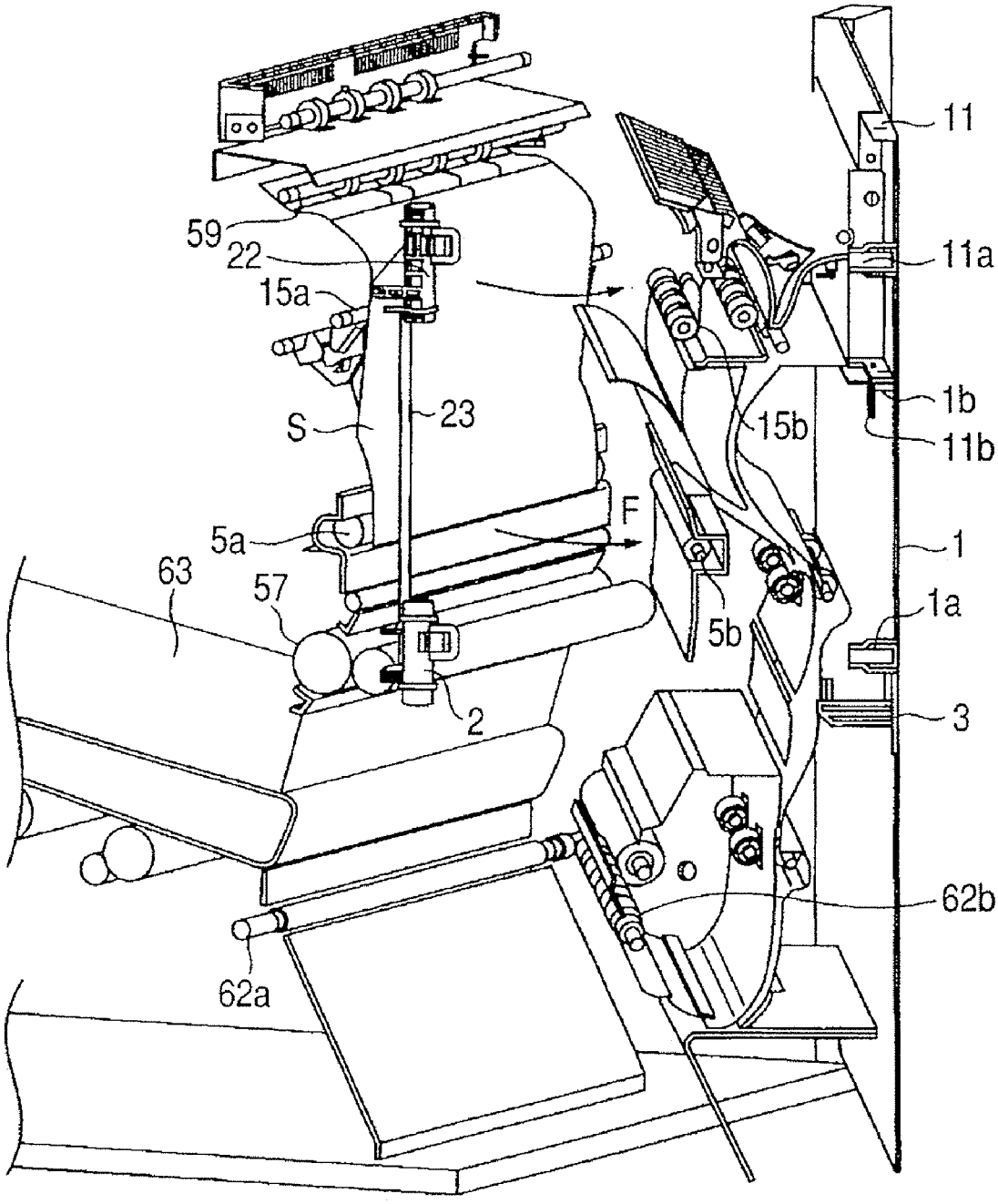
FIG. 6 shows a state when the first door and the second door have been opened.

When the releasing button 3 is thus depressed, the locking of the lock portions 1A and 11A of the first and second doors 1 and 11 can be released at a time by the releasing lever 23. Further, when the locking has been released, the first and second doors 1 and 11 come to be opened at a time as shown in FIG. 6 by the urging means urging the pairs of first and second conveying rollers 5 and 15. By the first and second doors 1 and 11 being thus opened, the pressure contact between the pairs of first and second conveying rollers 5 and 15 is released and therefore, the jammed sheet S becomes easy to clear.

Now, when the first and second doors 1 and 11 are opened at a time as described above, the stopper 11*b* of the second door 11 abuts against the stopper abutment portion 1*b* of the first door 1 and therefore, the opening amount of the first door 1 and the opening amount of the second door 11 become the opening amount of the first door 1 ≧ the opening amount of the second door 11.

On the other hand, when the first and second doors 1 and 11 are closed after the jammed sheet S has been cleared, the hooks 1*a* and 11*a* of the first and second doors 1 and 11 rotate the latches 2 and 22 urged in the direction indicated by the arrow A by the urging means (not shown), and are again engaged with the latch portions 2*a* and 22*a*.

Thereby, the first and second doors 1 and 11 are fixed at the positions forming the first, second, third, fourth and fifth conveying paths 101, 102, 103, 104 and 105, and the pairs of first and second conveying rollers 5 and 15 are brought into pressure contact with each other by the urging means (not shown), and a preparation for the next sheet conveyance is completed.

Figure 7A:
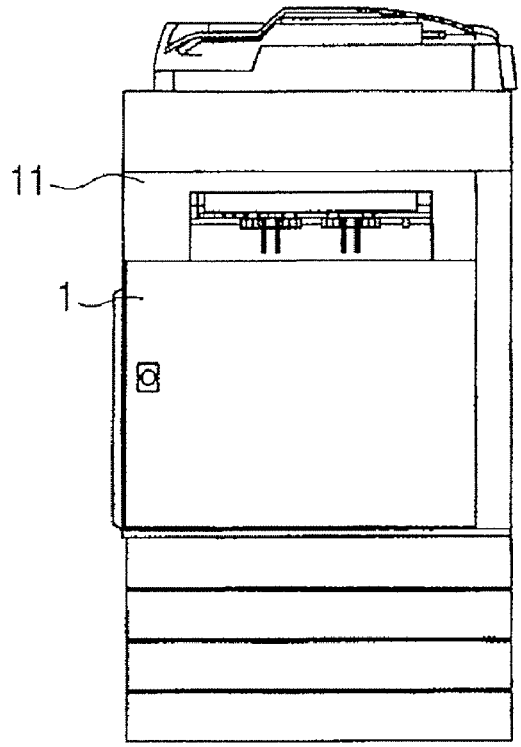
FIG. 7A shows a state when the first door and the second door have been closed.
Figure 7B:
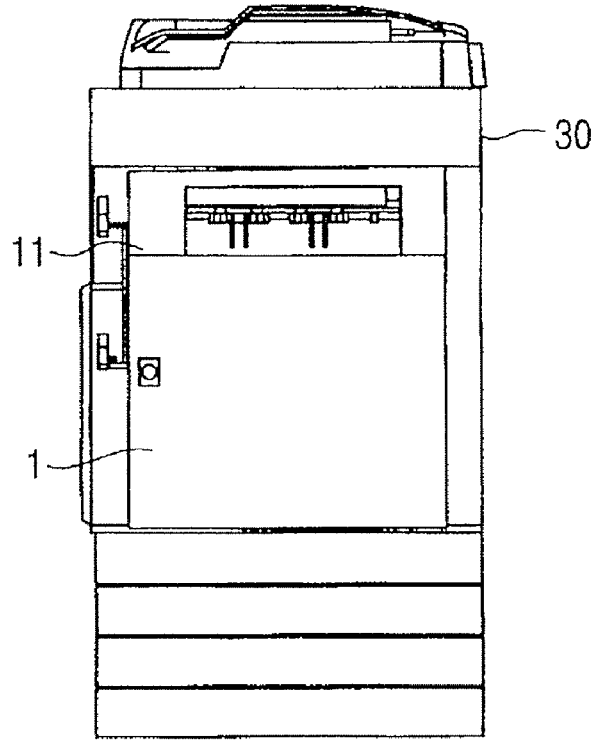
FIG. 7B shows a state when the first door and the second door have been opened.

Now, when the first and second doors 1 and 11 are closed, the height positions of the front and inner parts thereto are kept parallel to each other as shown in FIG. 7A, but when the two doors are opened, the rotation center shafts 4 and 14 of the first and second doors 1 and 11 are located on the inner part side and therefore, this side thereof is lowered by gravity as shown in FIG. 7B.

Figure 8:
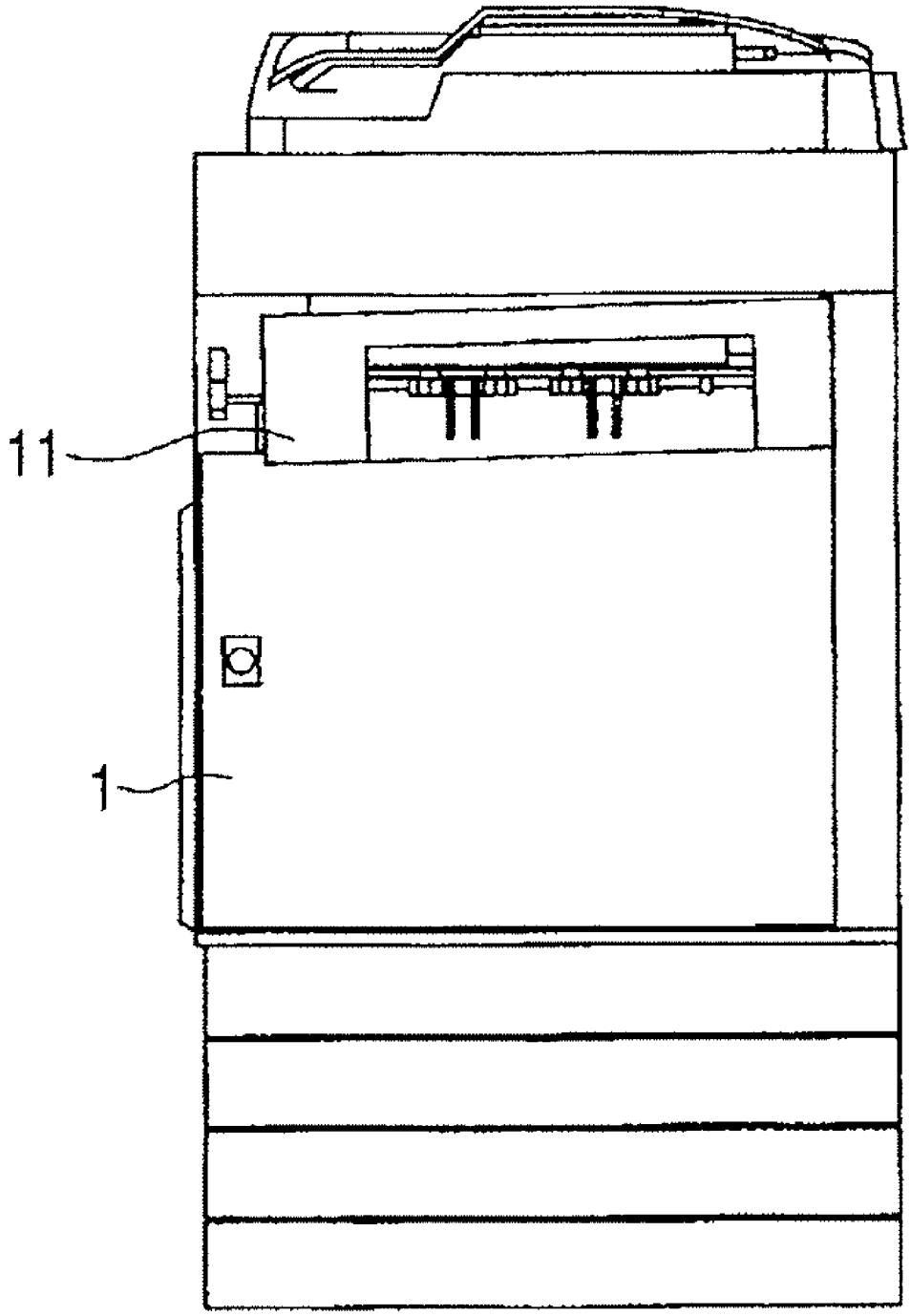
FIG. 8 shows the state of the second door when the first door has been closed earlier.
Figure 9:
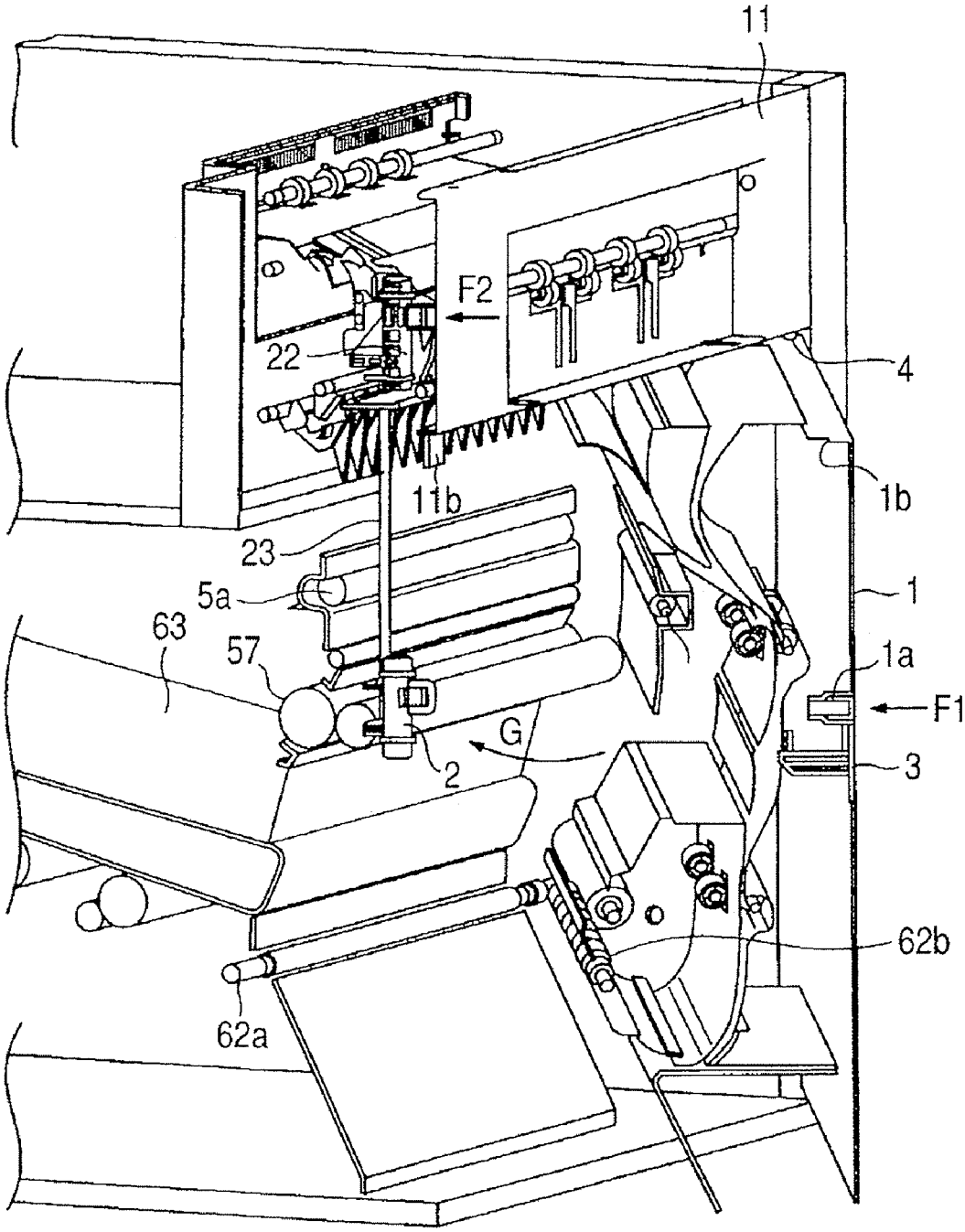
FIG. 9 shows a state when the first door and the second door are closed.

If in this state, an attempt is made to close the upper second door 11 after the lower first door 1 has been closed as shown in FIG. 8, this side of the second door 11 being lowered interferes with and injures the guide member 105*a* because the first door 1 has already been returned to its parallel position. If the guide member 105*a* is thus injured, the sheet may be caught thereby and paper jam may occur when the sheet passes through the fifth conveying path 105.

However, as already described, the second door 11 is provided with the stopper 11*b* for restricting the opening amount of the second door 11 and therefore, when an attempt is made to close the first door 1 earlier, the stopper abutment portion 1*b* of the first door 1 abuts against the stopper 11*b* of the second door 11.

However, when the stopper abutment portion 1*b* abuts against the stopper 11*b* of the second door 11 as described above, the load when the first door 1 is closed increases and therefore, a user closes the second door 11 earlier and thereafter closes the first door 1. Thereby, the guide member 105*a* of the second door 11 can be prevented from being injured.

That is, in the present embodiment, before the second door 11, which is the upper door is closed, the closing of the first door 1, which is the just-underlying door can be restricted by the stopper 11*b* and the abutment portion 1*b*. Therefore, the user can be sensuously instructed to close the second door 11 earlier than the first door 1, and the injury of the guide member 105*a* of the second door 11 can be reliably prevented.

When as described above, design is made such that the first door 1 is closed after the second door 11 has been closed, the force with which the second door 11 is closed in F2 and the force with which the first door 1 is closed is F1, and there is seen no increase in the operating force.

On the other hand, when the first door 1 is to be intactly closed, the stopper 11*b* and the stopper abutment portion 1*b* together constitute operatively associating means, and the first door 1 and the second door 11 are rotated together and closed with this side thereof remaining likewise lowered, and at the same time, are fixed at the position forming the conveying path.

As described above, design is made such that the locking of the first and second doors 1 and 11 is released by the manual operation of the releasing button 3 and also, that when the locking has been released, the first and second doors 1 and 11 bare opened at a time by the urging means, whereby the labor of the jam clearing operation can be reduced.

While in the present embodiment, the releasing button 3 is disposed on the first door 1, the present invention is not restricted thereto, but a similar effect can also be obtained even if the releasing button 3 is disposed on other main body portion than the doors. Also, while in the foregoing, description has been made of a case when the number of the doors is two, the present invention can be used to obtain a similar effect even in a case where the number of the doors is three or greater.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-266118, filed Sep. 13, 2005, which is hereby incorporated by reference herein in its entirety.

What is claimed is:

1. A sheet conveying apparatus provided with a sheet conveying path for conveying a sheet, comprising:

a plurality of doors provided vertically along said sheet conveying path in an apparatus main body, and supported openably and closably about an axis provided in a vertical direction for opening said sheet conveying path; and a restricting mechanism, which restricts, before an upper door of said plurality of doors is closed, a closing of a just-underlying door just below said upper door, said restricting mechanism being comprised of a stopper provided on said upper door and an abutment portion provided on said just-underlying door, wherein when said just-underlying door is closed, said abutment portion abuts against said stopper to close said upper door in operative association with a closing operation of said just-underlying door, and when said upper door is opened, said stopper abuts against said abutment portion to open said just-underlying door in operative association with an opening operation of said upper door.

2. A sheet conveying apparatus according to claim 1, further comprising:

a plurality of lock mechanisms, which lock said plurality of doors, respectively; and releasing means for releasing locks by said plurality of locking mechanisms at a time, wherein said plurality of doors are openable when said plurality of locking mechanisms are released by said releasing means.

3. An image forming apparatus provided with a sheet conveying path for conveying a sheet, and an image forming portion, which forms an image on the sheet conveyed on said sheet conveying path, said image forming apparatus comprising:

a plurality of doors provided vertically along said sheet conveying path in an apparatus main body, and supported openably and closably about an axis provided in a vertical direction for opening said sheet conveying path; and a restricting mechanism, which restricts, before an upper door of said plurality of doors is closed, a closing of a just-underlying door just below said upper door, said restricting mechanism being comprised of a stopper provided on said upper door and an abutment portion provided on said just-underlying door, wherein when said just-underlying door is closed, said abutment portion abuts against said stopper to close said upper door in operative association with a closing operation of said just-underlying door, and when said upper door is opened, said stopper abuts against said abutment portion to open said just-underlying door in operative association with an opening operation of said upper door.

4. An image forming apparatus according to claim 3, further comprising:

a plurality of lock mechanisms, which lock said plurality of doors, respectively; and releasing means for releasing locks by said plurality of locking mechanisms at a time, wherein said plurality of doors are openable when said plurality of locking mechanisms are released by said releasing means.

* * * * *